US011047391B2

(12) United States Patent
Des et al.

(10) Patent No.: US 11,047,391 B2
(45) Date of Patent: Jun. 29, 2021

(54) MOTOR VEHICLE VACUUM PUMP

(71) Applicant: PIERBURG PUMP TECHNOLOGY GMBH, Neuss (DE)

(72) Inventors: Enver Des, Neuss (DE); Moritz Johannes Job, Duesseldorf (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 128 days.

(21) Appl. No.: 15/115,694

(22) PCT Filed: Feb. 2, 2015

(86) PCT No.: PCT/EP2015/052090

§ 371 (c)(1),
(2) Date: Aug. 1, 2016

(87) PCT Pub. No.: WO2015/124415

PCT Pub. Date: Aug. 27, 2015

(65) Prior Publication Data

US 2017/0009770 A1 Jan. 12, 2017

(30) Foreign Application Priority Data

Feb. 18, 2014 (EP) ..... 14155617

(51) Int. Cl.
*F04C 29/06* (2006.01)
*F04C 29/12* (2006.01)
(Continued)

(52) U.S. Cl.
CPC ..... *F04C 29/06* (2013.01); *F04C 25/02* (2013.01); *F04C 29/128* (2013.01); *F04C 18/34* (2013.01);
(Continued)

(58) Field of Classification Search
CPC ..... F04C 29/06; F04C 29/128; F04C 25/02; F04C 29/126; F04C 18/344;
(Continued)

(56) References Cited

U.S. PATENT DOCUMENTS 5,720,601 A 2/1998 Tark et al.
5,934,305 A * 8/1999 Cho ..... F04B 39/1066 137/15.18
(Continued)

FOREIGN PATENT DOCUMENTS

CN 1137613 A 12/1996
DE 102 27 772 A1 1/2003
(Continued)

OTHER PUBLICATIONS

EP1953389 Translation, Friesen; Alber, Aug. 2006, EPO.*

*Primary Examiner* — Charles G Freay
*Assistant Examiner* — David N Brandt
(74) *Attorney, Agent, or Firm* — Norman B. Thot

(57) ABSTRACT

A motor vehicle vacuum pump includes a pumping chamber in which a pump rotor rotates to compress a gas, an outlet chamber into which the gas exits, a separation wall which includes a valve opening and a valve seat arranged on an outlet side of the separation wall around the valve opening. The separation wall separates the pumping chamber from the outlet chamber. An outlet valve is formed as a non-return valve in the separation wall. The outlet valve is formed by the valve opening in the separation wall and includes a valve body with a closing body. The outlet valve has the gas exit therethrough from the pumping chamber into the outlet chamber. A corresponding part of the closing body is supported on the valve seat when the closing body is in a closed position. The valve seat and/or the corresponding part of the closing body includes microgrooves.

11 Claims, 3 Drawing Sheets

(51) Int. Cl.
*F04C 25/02* (2006.01)
*F04C 18/34* (2006.01)

(52) U.S. Cl.
CPC ..... *F04C 2220/10* (2013.01); *F04C 2240/10* (2013.01); *F04C 2240/20* (2013.01); *F04C 2270/13* (2013.01)

(58) Field of Classification Search
CPC .. F04C 2240/20; F04C 2240/10; F04C 18/34; F04C 2270/13; F04C 2220/10
See application file for complete search history.

(56) References Cited

U.S. PATENT DOCUMENTS

2010/0155382 A1* 6/2010 Tanihara ..... B23K 26/36
219/121.85
2012/0301341 A1* 11/2012 Ota ..... F04B 27/1009
417/559

FOREIGN PATENT DOCUMENTS

| | | | |
|---|---|---|---|
| EP | 1 953 389 | A2 | 8/2008 |
| GB | 2 214 615 | B | 2/1992 |
| JP | 60-122287 | A | 6/1985 |
| JP | 9-291960 | A | 11/1997 |
| JP | 2010-262860 | A | 11/2010 |
| KR | 10-0253656 | B1 | 5/2000 |

* cited by examiner

MOTOR VEHICLE VACUUM PUMP

CROSS REFERENCE TO PRIOR APPLICATIONS

This application is a U.S. National Phase application under 35 U.S.C. § 371 of International Application No. PCT/EP2015/052090, filed on Feb. 2, 2015 and which claims benefit to European Patent Application No. 14155617.5, filed on Feb. 18, 2014. The International Application was published in German on Aug. 27, 2015 as WO 2015/124415 A1 under PCT Article 21(2).

FIELD

The present invention relates to a motor vehicle vacuum pump designed as a displacement pump, for example, as a vane pump. The motor vehicle vacuum pump is an auxiliary aggregate in a motor vehicle which is driven, for example, directly by an internal combustion engine or by a separate electric drive motor.

BACKGROUND

The motor vehicle vacuum pump comprises a pumping chamber in which the pump rotor rotates, in which the rotor compresses gas, generally air, in the pumping chamber and expels the gas into an outlet chamber via an outlet valve. The outlet valve prevents a return flow of compressed gas from the outlet chamber into the pumping chamber. A leaf spring valve is often used as the outlet valve due to its simple structure and high reliability, wherein the valve body is designed as a leaf spring which, in the closed position, rests on a valve seat surrounding the valve opening and is lifted off from the valve seat if the pressure difference is sufficient so that the outlet valve is opened. The generation of noise is problematic or at least undesirable with vacuum pumps having outlet valves, in which noise results substantially from the fast acceleration of the valve body, the lubricant in the case of a lubricated vacuum pump, and the sudden compression or decompression of the gas.

A mechanical motor vehicle vacuum pump is described in DE 102 27 772 A1 wherein, for the purpose of noise reduction, a channel or an opening is provided near the outlet valve in order to gradually reduce pressure variations in this area.

A mechanical motor vehicle vacuum pump is described in EP 1 953 389 A2 wherein, for the purpose of noise reduction, the valve body designed as a leaf spring is formed with an opening in order to gradually reduce pressure variations in this area. This design may cause a significant reduction of noise, however, the opening behavior and the generation of noise when the outlet valve opens are not always satisfactory, especially at high rotational speeds of the vacuum pump.

SUMMARY

An aspect of the present invention is to provide a motor vehicle vacuum pump with reduced noise generation.

In an embodiment, the present invention provides a motor vehicle vacuum pump which includes a pump rotor, a pumping chamber in which the pump rotor is arranged to rotate so as to provide a compressed gas, an outlet chamber into which the compressed gas exits from the pumping chamber, a separation wall comprising a valve opening and a valve seat arranged on an outlet side of the separation wall around the valve opening. The separation wall is configured to separate the pumping chamber from the outlet chamber. An outlet valve is formed as a non-return valve in the separation wall. The outlet valve is formed by the valve opening in the separation wall and comprises a valve body which comprises a closing body. The outlet valve is configured to have the compressed gas exit from the pumping chamber into the outlet chamber therethrough. A corresponding part of the closing body is supported on the valve seat when the closing body is in a closed position. At least one of the valve seat and the corresponding part of the closing body comprises microgrooves oriented in a lateral direction.

BRIEF DESCRIPTION OF THE DRAWINGS

The present invention is described in greater detail below on the basis of embodiments and of the drawings in which.

DETAILED DESCRIPTION

Figure 1:
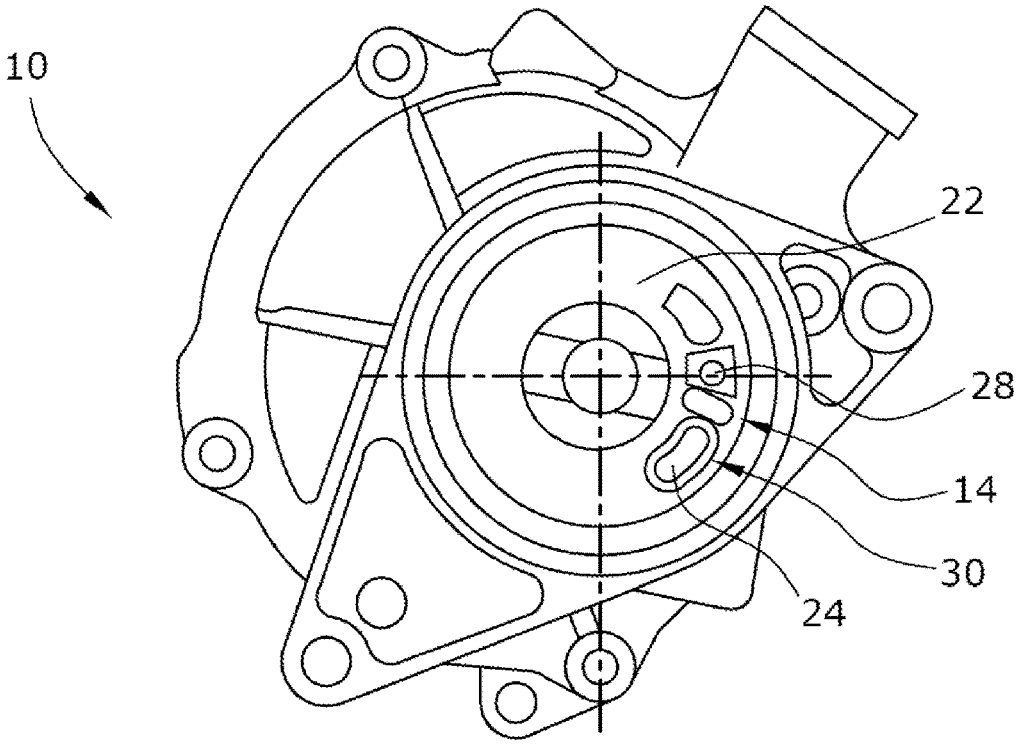
FIG. 1 shows an open motor vehicle vacuum pump showing a separation wall which separates the pumping chamber from the outlet chamber in which an outlet valve is provided.

In an embodiment of the present invention, the valve seat and/or the corresponding part of the valve body closure body have a plurality of microgrooves directed in a quasi star-shaped manner in a lateral direction, that is, for example, in the case of a circular valve opening, they are arranged almost radially. The microgrooves thereby form a drain in the closing plane of the outlet valve so that a faster pressure compensation is affected in the interface between the valve seat and the corresponding part of the closure body when the outlet valve is opened. In the case of an oil-lubricated vacuum pump, it is thereby in particular possible to significantly reduce the separation force necessary to overcome the adhesive force between the valve seat and the corresponding edge portion of the closure body. The opening movement of the closure body thereby becomes more harmonious so that noise generation during opening is also reduced. The closing movement also becomes more harmonious so that noise generation during the closing of the outlet valve is also reduced.

In an embodiment of the present invention, the groove depth t of the microgrooves can, for example, be less than 0.2 mm, for example, less than 0.1 mm. The groove width of the microgrooves can, for example, be less than 0.5 mm, for example, less than 0.25 mm. Tests have shown that relatively few microgrooves, for example, fewer than a total of 100 microgrooves, already cause a significant reduction of noise emissions. Because the microgrooves have a relatively small opening cross section, be it individually or in total, return flow losses caused by the microgrooves are negligible.

In an embodiment of the present invention, the ratio of the length l of the microgrooves to their mutual lateral distance d can, for example, be greater than 1.0 over at least one half of an area of valve seat. In other words, the distance between two microgrooves is generally shorter than the length of the microgrooves. In an embodiment of the present invention, the microgrooves do not cross each other, but can, for example, be arranged in a star-shaped manner. In rectilinear regions of the valve seat, the microgrooves can, for example, be arranged in parallel with each other.

In an embodiment of the present invention, the microgrooves can, for example, be provided either only on the valve seat or on the closure body. The microgrooves can, for example, only be provided on the valve seat that surrounds the valve opening. Positive noise emission effects are not significantly enhanced by providing the microgrooves both on the valve seat and on the closure body of the valve body so that the provision of the microgrooves on only one side of the interface allows manufacturing costs to be kept relatively low without suffering any functional disadvantage.

In the closed state of the outlet valve, a longitudinal end of the microgrooves can, for example, be open to the valve opening and the other longitudinal end of the microgrooves can, for example, be open to the outlet chamber. When the outlet valve is fully closed, i.e., when the closure body fully rests on the valve seat, the two longitudinal ends of the microgrooves are open so that the maximum possible drainage function is available in the longitudinal direction of the grooves even when the outlet valve is completely closed.

In an embodiment of the present invention, the valve seat can, for example, be formed with a raised shape. This simple measure in particular provides that the microgrooves are always open to the outlet chamber at their respective outer longitudinal end.

In an embodiment of the present invention, the microgrooves can, for example, be manufactured via a laser engraving or a stamping. The opening and closing behavior of the outlet valve can thus be significantly improved using a relatively simple method.

In an embodiment of the present invention, the valve body can, for example, be designed as a leaf spring. Such a conception of the valve body is economic and mechanically reliable.

Two embodiments of the present invention will be explained in detail below with reference to the drawings.

Figure 5:
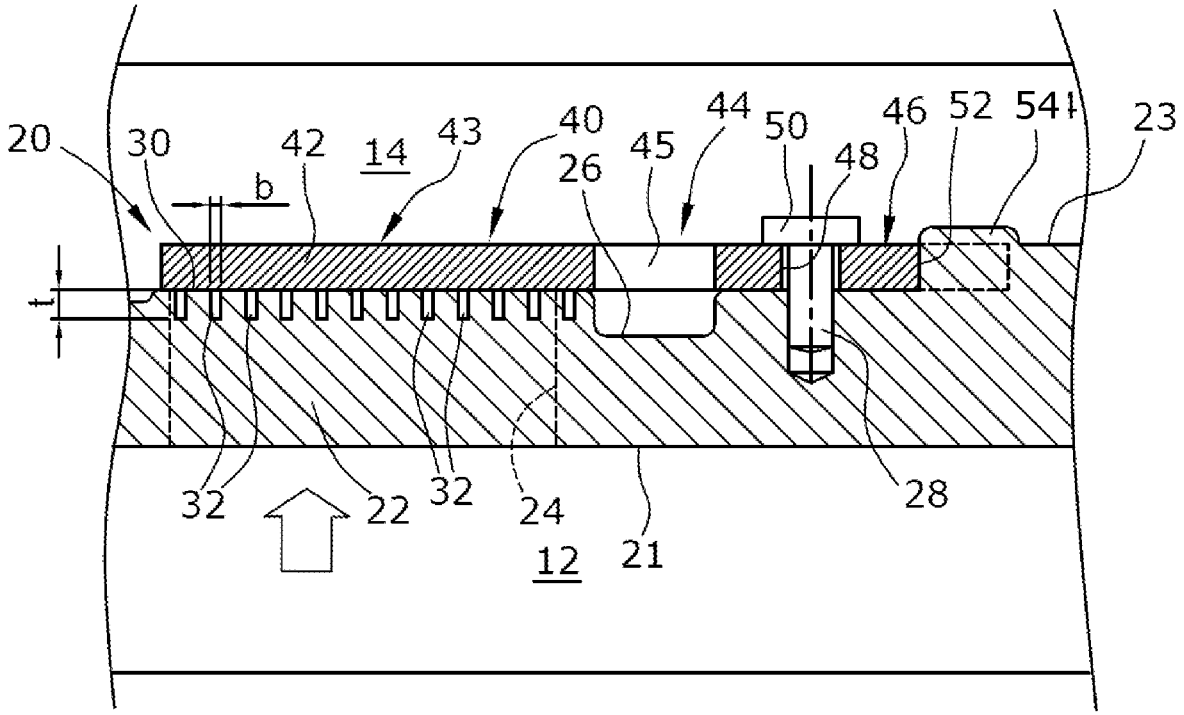
FIG. 5 shows a cross section of the separating wall in the area of the outlet valve.
Figure 6:
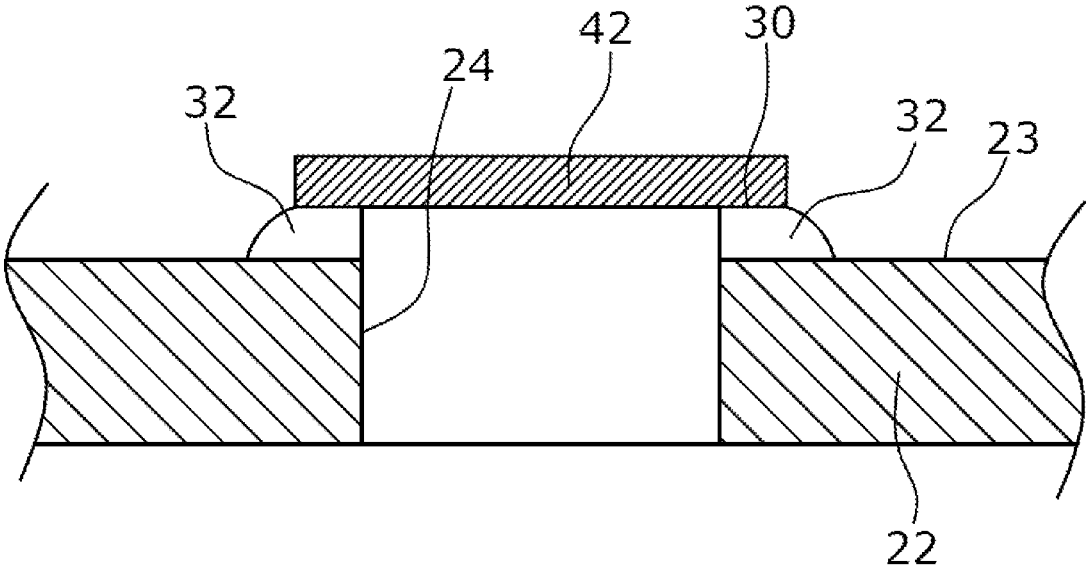
FIG. 6 shows the microgrooves extending from the valve opening to the outlet chamber.

FIG. 1 shows an open motor vehicle vacuum pump 10, wherein a separating wall 22 can be seen that separates a pumping chamber 12 from an outlet chamber 14, as illustrated in the sectional view shown in FIG. 5. The vacuum pump 10 is a so-called mechanical vacuum pump mechanically driven by an internal combustion engine, i.e., rotating at a rotational speed proportional to the rotational speed of the internal combustion engine. For example, the vacuum pump 10 in the mounted state is driven directly via the camshaft of the internal combustion engine.

The vacuum pump 10 is designed as a compressor pump and discontinuously compresses gas, in particular air. To prevent a return flow of the gas from the outlet chamber 14 back into the pumping chamber 12 between two pressure intervals, a separating wall 22 is provided with an outlet valve 20 that opens at a corresponding overpressure in the pumping chamber 12 and prevents a return flow of the gas from the outlet chamber 14 back into the pumping chamber 12 when no overpressure prevails.

The outlet valve 20 is illustrated in section together with the separating wall 22 in FIG. 5. The outlet valve 20 is designed as a so-called leaf spring valve. An oblong curved valve opening 24 is provided in the separating wall 22. On the outlet-chamber side 23 of the separating wall 22, which is opposed by the pumping-chamber side 21, a valve body 40; 40' is fixed which is illustrated in a top view on its pumping-chamber side in a first embodiment in FIG. 3 and in a second embodiment in FIG. 4. The valve body 40; 40' has three sections in the longitudinal direction, namely, a closure body section 43; 43', a hinge section 44, and a fastening section 46.

The valve body 40; 40' is made of spring sheet and has a constriction 45 in its hinge section 44, whereby the valve body 40; 40' is designed to be more easily flexed in the hinge section 44 than in the adjoining closure body section 43 and the fastening section 46. In the fastening section 46, the valve body 40; 40' has a fastening opening 48 and a recess 52. The valve body 40 is fixed by a fastener 50 in a bore 28 of the separating wall 22, which bore 28 may be provided with a thread. The fastener 50 may be a screw, a rivet, or any another suitable fastener. The recess 52 embraces a raised holding nose 54 of the separating wall 22 so that the fastener 50 and the raised holding nose 54 fix the valve body 40 on the separating wall 22 in a defined and non-rotatable manner. The separating wall 22 has a hinge recess 26 in the area of the hinge section 44 of the valve body 40.

A closure body 42; 42' is arranged at the other longitudinal end of the valve body 40; 40', which closure body 42; 42' completely closes the valve opening 24 in its closing position as illustrated in FIG. 5.

Figure 3:
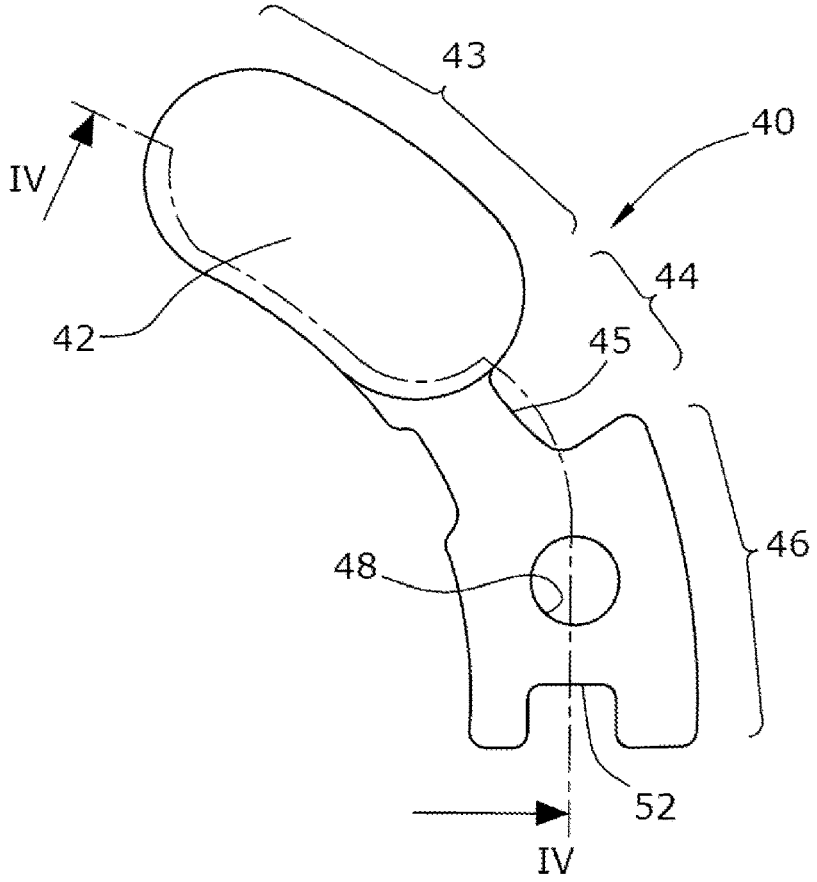
FIG. 3 shows a top plan view of the side of the valve body on the pumping chamber side in an embodiment.
Figure 4:
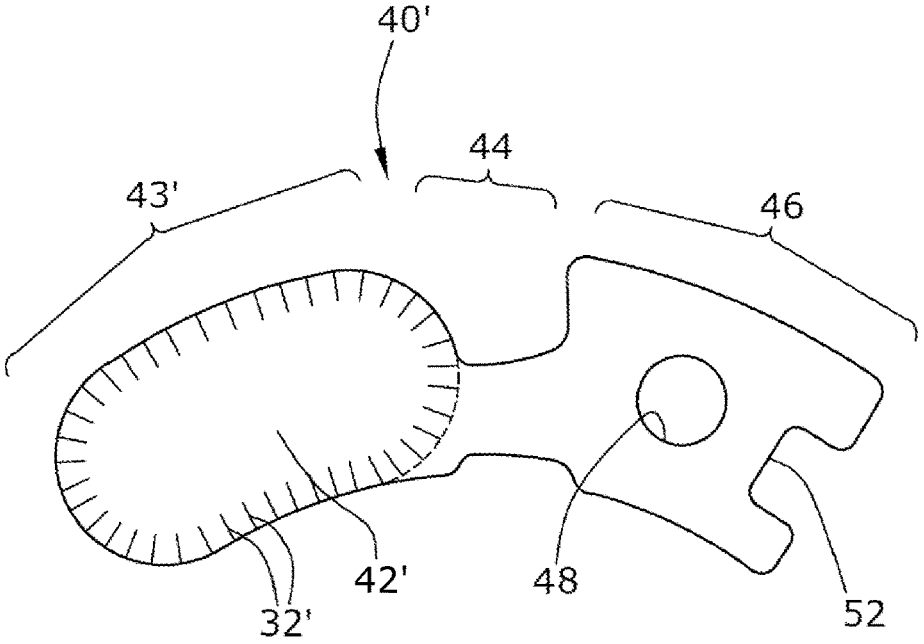
FIG. 4 shows a top plan view of the side of the valve body on the pumping chamber side in an embodiment.

The separating wall 22 has a valve seat 30 on the outlet side 23 which is designed to be raised with respect to the base plane of the separating wall 22 and to be plane, on which valve seat 30 the corresponding strip-shaped edge portion of the pumping-chamber side of the closure body, illustrated in FIGS. 3 and 4, rests in the closing position. The web-like valve seat 30 has a raised height of about 1 mm relative to the adjacent regions.

In the first embodiment illustrated in FIGS. 3 and 5, the valve seat has 30 to 50 microgrooves 32 oriented in the lateral direction, i.e., the microgrooves 32 extend in a star-shaped manner from the inside outward and do not cross each other. The microgrooves 32 are oriented almost perpendicular with respect to the opening edge. The microgrooves 32 are formed in the valve seat 30 by laser engraving. The microgrooves 32 typically have a groove depth t of 0.025 mm and a groove width b of 0.1 mm. The length 1 of the microgrooves 32 may 1.0 to 2.0 mm, the lateral distance d between two adjacent microgrooves is less than 1.0 mm. The mean lateral distance d is always smaller than the length 1 of the microgrooves 32.

Figure 2:
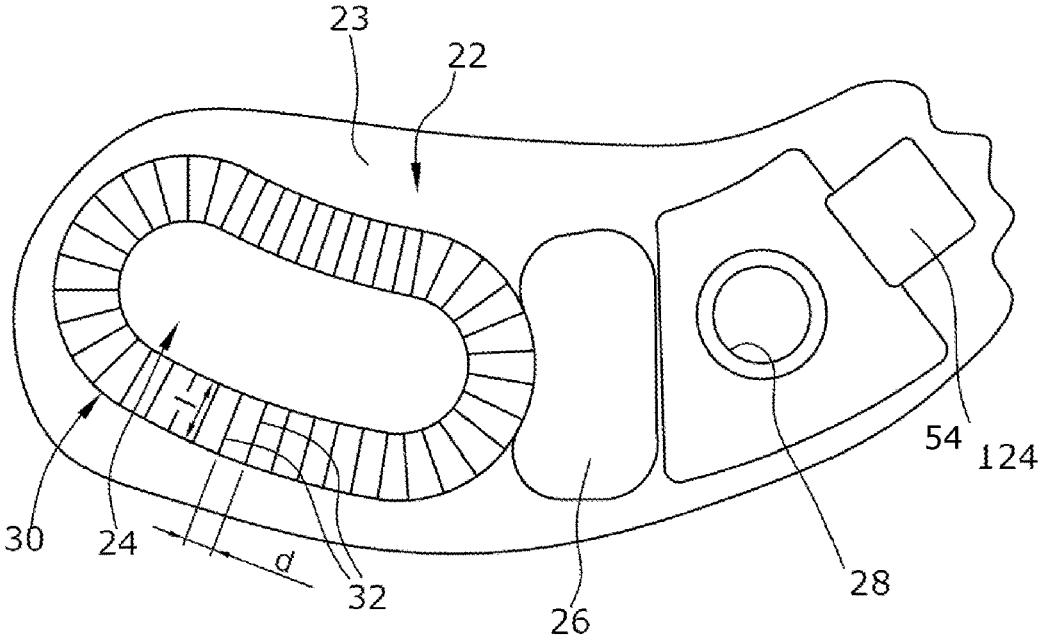
FIG. 2 shows a top plan view of the separating wall including the valve seat in the area of the outlet valve.

In a second embodiment, the valve body 40' has microgrooves 32' on its side facing to the valve seat 30, which microgrooves 32' have the same dimensions and orientation as the microgrooves 32 in the valve seat 30. The valve body 40' with the microgrooves 32' may be combined with a valve seat without microgrooves or with a valve seat 30 as illustrated in FIGS. 2 and 5 with microgrooves 32.

The microgrooves 32 on the valve seat 30 are open at their two longitudinal ends so that the outer longitudinal ends are open to the outlet chamber 14 and the inner longitudinal ends are open to the pumping chamber 12. A fluid flow may thereby always flow into and out of the respective microgrooves at both longitudinal sides so that a corresponding pressure compensation is always possible in the microgroove 32. A draining of the valve seat 30 is provided in all operating states of the outlet valve 20.

The vacuum pump 10 can, for example, be oil-lubricated so that oil in particular flows in and out through the microgrooves 32; 32' during an opening and a closing operation. The valve body 40; 40' is pre-tensioned so that it opens at a differential pressure of about 0.04 bar. Oil may flow through the microgrooves 32; 32' towards the center of the opening already at the above-mentioned differential pressure so that the oil film between the valve seat 30 and the closure body 42; 42' tears quickly. This allows for a harmonious opening movement of the valve body 40 so that the sound emissions are significantly reduced. This also analogously applies to the closing movement.

The present invention is not limited to embodiments described herein; reference should be had to the appended claims.

What is claimed is:

1. A motor vehicle vacuum pump comprising:

a pumping chamber which is configured to provide a compressed gas;

an outlet chamber into which the compressed gas exits from the pumping chamber;

a separation wall comprising a valve opening and a valve seat arranged on an outlet side of the separation wall around the valve opening, the separation wall being configured to separate the pumping chamber from the outlet chamber;

an outlet valve formed as a non-return valve in the separation wall, the outlet valve being formed by the valve opening in the separation wall and comprising a valve body which comprises a closing body, the outlet valve being configured to have the compressed gas exit from the pumping chamber into the outlet chamber therethrough, wherein, a corresponding part of the closing body is supported on the valve seat when the closing body is in a closed position, the valve seat comprises microgrooves oriented in a lateral direction, the microgrooves comprise a first longitudinal end and a second longitudinal end, and when the closing body is in a fully closed position so that the closing body fully rests on the valve seat, the first longitudinal end of the microgrooves is open to the valve opening and the second longitudinal end of the microgrooves is open to the outlet chamber by extending beyond an edge of the closing body.

2. The motor vehicle vacuum pump as recited in claim 1, wherein the microgrooves comprise a groove depth which is less than 0.2 mm.

3. The motor vehicle vacuum pump as recited in claim 2, wherein the groove depth is less than 0.1 mm.

4. The motor vehicle vacuum pump as recited in claim 1, wherein the microgrooves comprise a groove width which is less than 0.5 mm.

5. The motor vehicle vacuum pump as recited in claim 4, wherein the groove width is less than 0.25 mm.

6. The motor vehicle vacuum pump as recited in claim 1, wherein, the microgrooves comprise a length and a mutual lateral distance, and for at least a half of an area of the valve seat, a ratio of the length of the microgrooves to the mutual lateral distance of the microgrooves is greater than 1.0.

7. The motor vehicle vacuum pump as recited in claim 1, wherein the microgrooves are configured to not cross each other.

8. The motor vehicle vacuum pump as recited in claim 1, wherein the valve seat comprises fewer than 50 of the microgrooves.

9. The motor vehicle vacuum pump as recited in claim 1, wherein the microgrooves are made using a laser engraving process or a stamping process.

10. The motor vehicle vacuum pump as recited in claim 1, wherein the valve body is designed as a leaf spring.

11. A motor vehicle vacuum pump comprising:

a pumping chamber which is configured to provide a compressed gas;

an outlet chamber into which the compressed gas exits from the pumping chamber;

a separation wall comprising a valve opening and a valve seat arranged on an outlet side of the separation wall around the valve opening, the separation wall being configured to separate the pumping chamber from the outlet chamber;

an outlet valve formed as a non-return valve in the separation wall, the outlet valve being formed by the valve opening in the separation wall and comprising a valve body which comprises a closing body, the outlet valve being configured to have the compressed gas exit from the pumping chamber into the outlet chamber therethrough, wherein, a corresponding part of the closing body is supported on the valve seat when the closing body is in a closed position, the valve seat comprises microgrooves oriented in a lateral direction, the microgrooves comprise a first longitudinal end and a second longitudinal end, and when the closing body is in a fully closed position so that the closing body fully rests on the valve seat, the first longitudinal end of the microgrooves is open to the valve opening and the valve seat extends laterally beyond an edge of the closing body.

* * * * *